US006286979B1

(12) United States Patent
Ramer et al.

(10) Patent No.: US 6,286,979 B1
(45) Date of Patent: Sep. 11, 2001

(54) CONSTRUCTIVE OCCLUSION LIGHTING SYSTEM WITH PORTED CAVITY AND FAN STRUCTURE

(76) Inventors: David P. Ramer, 1516 Deer Point Way, Reston, VA (US) 20194; Jack C. Rains, Jr., 2946 Timber Wood Way, Herndon, VA (US) 22071; Matthew Brown, 6303 Crooked Oak La., Falls Church, VA (US) 22042

( * ) Notice: Subject to any disclaimer, the term of this patent is extended or adjusted under 35 U.S.C. 154(b) by 0 days.

(21) Appl. No.: 09/512,086

(22) Filed: Feb. 24, 2000

(51) Int. Cl.[7] ..... F21V 7/00

(52) U.S. Cl. ..... 362/297; 362/298; 362/301; 362/302; 362/303; 362/304; 362/305; 362/346

(58) Field of Search ..... 362/297, 298, 362/301, 302, 303, 304, 305, 346

(56) References Cited

U.S. PATENT DOCUMENTS 3,796,886 * 3/1974 Freeman ..... 250/493
5,335,158 * 8/1994 Kaplan et al. ..... 362/303
5,733,028 3/1998 Ramer et al. .
5,914,487 6/1999 Ramer et al. .
6,007,225 12/1999 Ramer et al. .
6,043,873 3/2000 Ramer et al. .
6,064,061 5/2000 Ramer et al. .
6,161,939 * 12/2000 Bansbach ..... 362/223

* cited by examiner

*Primary Examiner*—Thomas M. Sember
*Assistant Examiner*—Ali Alavi
(74) *Attorney, Agent, or Firm*—McDermott, Will & Emery

(57) ABSTRACT

An optical integrating cavity supplies light or other radiant energy through a port to a deflector. The deflector coupled to the port may form a "fan" extending along one side or around all or part of the circumference of the cavity. Preferred embodiments use principles of constructive occlusion (diffuse reflectivity in a mask and cavity structure) together with the port and deflector structure. The cavity and mask serve as the optical integrating cavity. The constructive occlusion provides a tailored intensity distribution for radiant energy illuminating a first region; whereas the integrating cavity, port and deflector distribute another portion of the electromagnetic energy over a second field of intended illumination. The first and second areas illuminated may overlap slightly, or one may include the other, but preferably most of the two areas are separate. In some cases, the system configuration creates a dead zone between the two regions.

40 Claims, 9 Drawing Sheets

FIG. 8
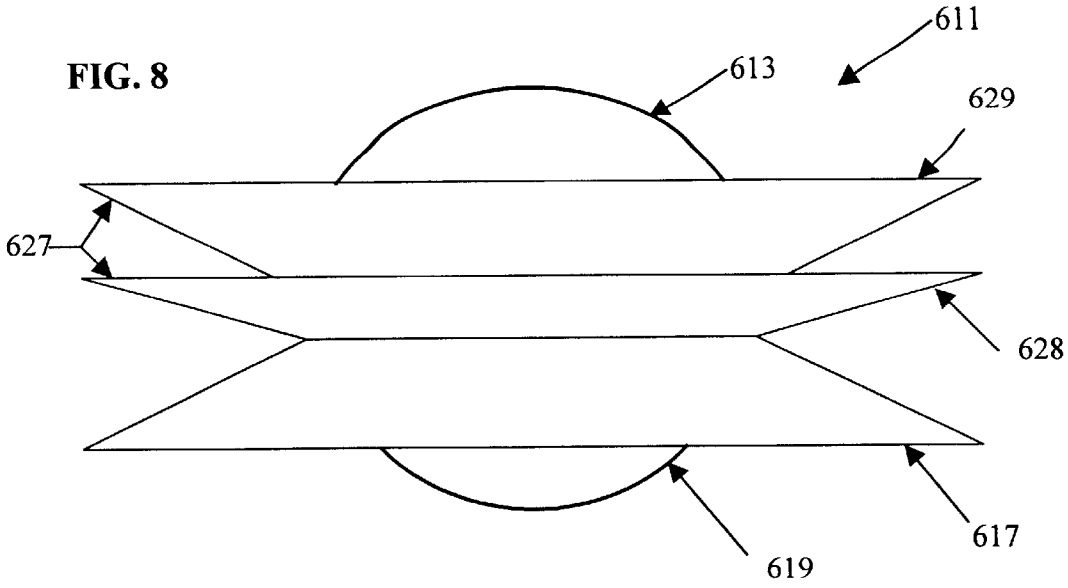
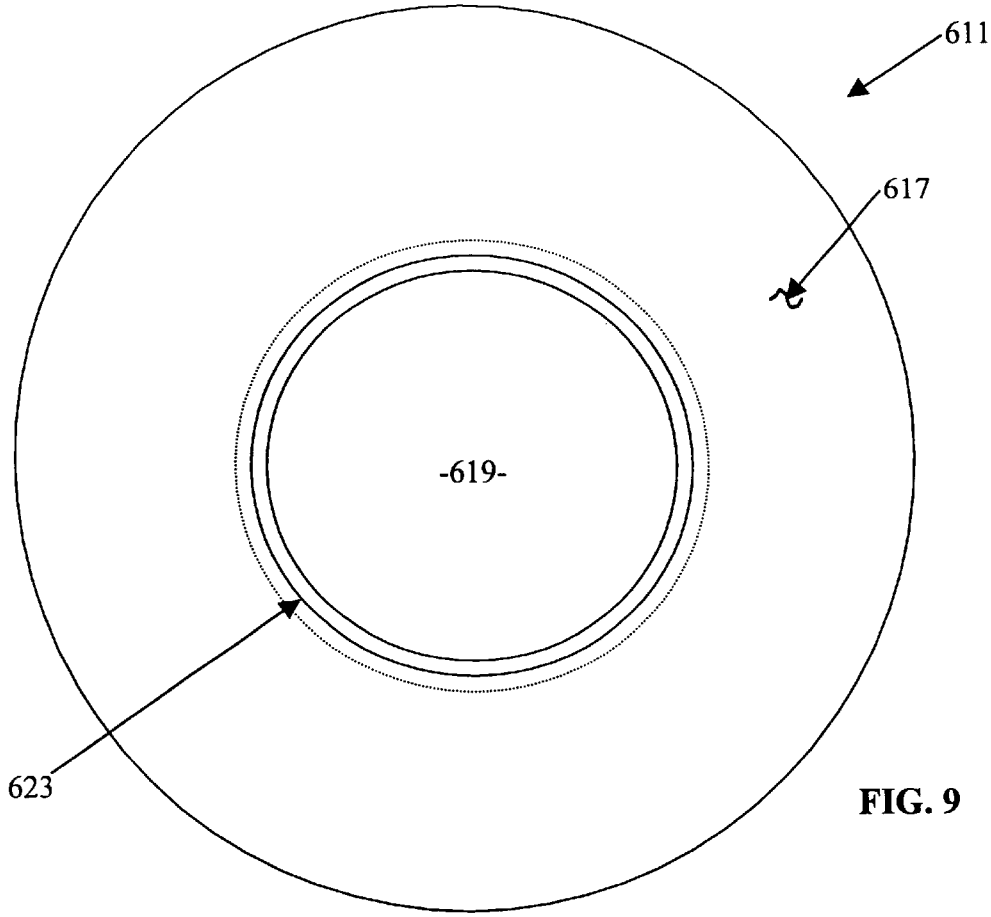
FIG. 9

FIG. 10
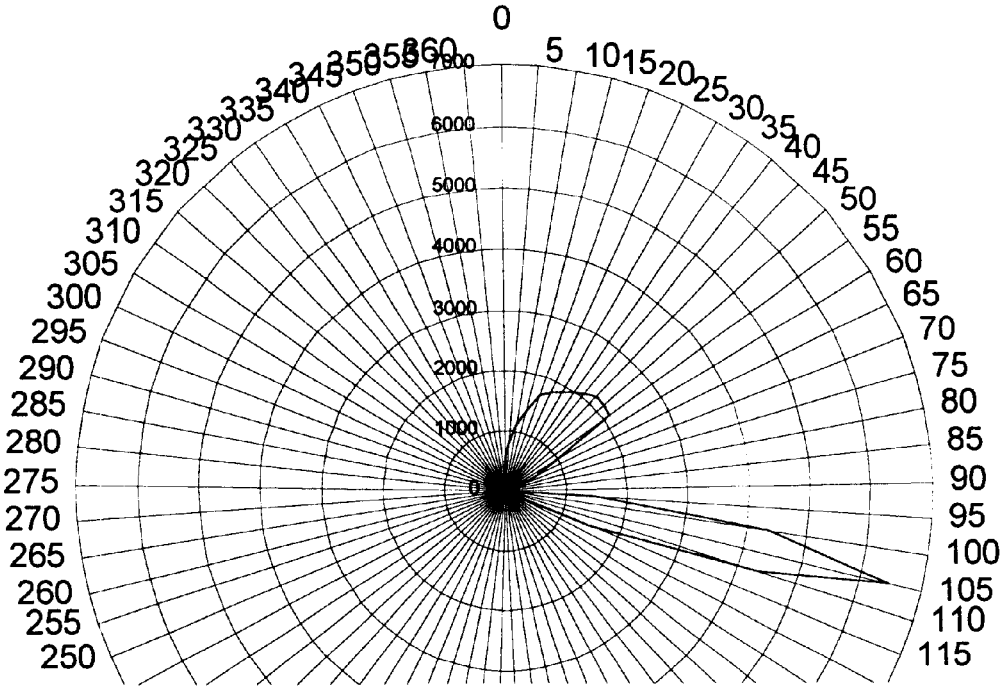
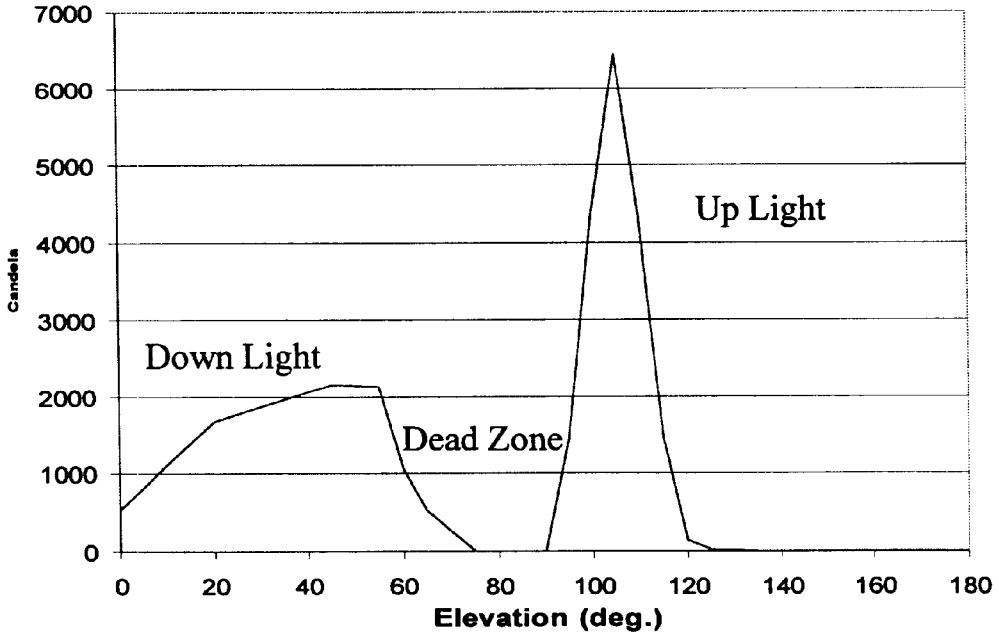
FIG. 11

FIG. 12
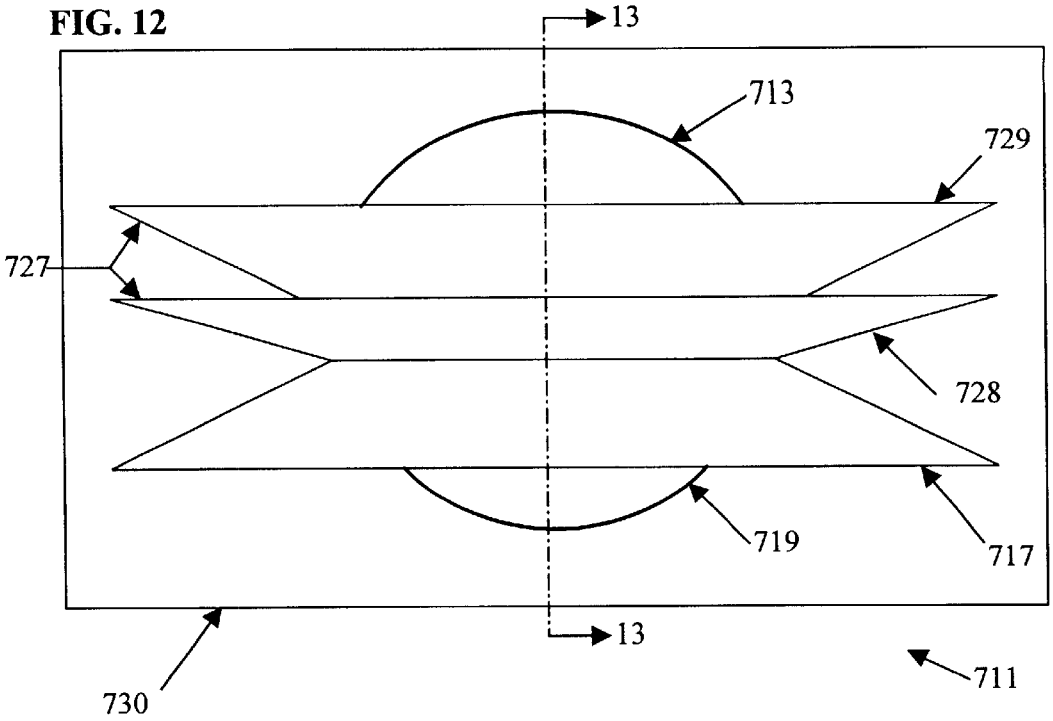
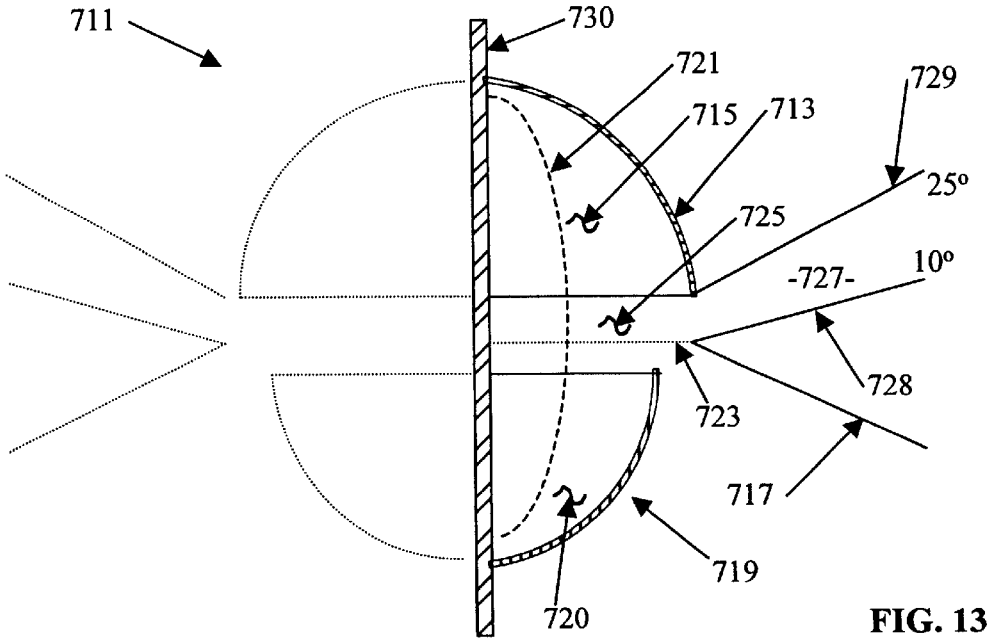
FIG. 13

CONSTRUCTIVE OCCLUSION LIGHTING SYSTEM WITH PORTED CAVITY AND FAN STRUCTURE

FIELD OF THE INVENTION

The present invention relates to systems for illuminating a desired area with electromagnetic radiation, such as visible or infrared light, with a desired intensity distribution, for example using an integrating cavity, a port and a fan-shaped deflector structure. Preferably, the cavity takes the form a constructive occlusion type mask, cavity and shoulder providing a tailored intensity distribution of radiant energy over one region, while the port and deflector provide illumination of another region.

BACKGROUND

Radiant or electromagnetic energy emitters and distributors find a wide range of applications in modern society. Visible illumination systems, for example, illuminate areas and surfaces to enable use by personnel even though natural ambient lighting might be insufficient. Infrared illumination is a critical component of many night-vision technologies.

Different applications of radiant energy illumination systems require different performance characteristics. For example, a visible illumination application might require that the lighting system provides a desired minimum intensity over a flat surface of specified dimensions about an axis of the lighting system, at a known distance from the system along its axis. Simple radiation sources, such as light emitting diodes (LEDs) or light bulbs with reflectors and/or lenses typically provide a high intensity radiation in regions close to the axis, but the intensity drops off quickly at angles approaching the horizon. On an illuminated surface, the intensity is not uniform, as often desired.

To provide a desired illumination at edges of a design footprint, the source often will emit substantially higher amounts of radiation than necessary along the axis. Although such an approach may meet minimum requirements, it requires an excessive amount of power.

Prior attempts to provide desired intensity distributions have involved complex arrangements of sources, lenses and reflectors. These complex arrangements tend to be relatively expensive and sensitive to problems of misalignment, which limits ruggedness and durability.

As an example of a difficult lighting application, consider illumination of the vehicle filling area, under a canopy, in a modern self-serve type gas station or the like. Light fixtures are attached to the underside of the canopy. Such fixtures must distribute light downward toward the ground. The illumination system must also provide some illumination at an angle to illuminate vertical surfaces of the pumps. To achieve desired lighting, the requirements for such an application actually specify desired downward intensity and angular coverage and require some amount of up-lighting at an angle onto the underside of the canopy. A problem arises, however, where illumination systems meeting such requirements also distribute a substantial portion of the light outward at angles approaching the horizon. The light emitted in this later direction actually "trespasses" on adjacent properties, and in many instances, is disturbing to persons living on or using the adjacent properties.

U.S. Pat. No. 5,733,028 issued Mar. 31, 1998 to Ramer et al. discloses a number of embodiments of illumination systems that utilize constructive occlusion. With this technology, a mask occludes an active optical surface, typically a Lambertian surface formed by the aperture of a diffusely reflective cavity. In most embodiments, a reflective shoulder surrounds all or at least a portion of the aperture. The mask, cavity and shoulder distribute radiant energy from within the cavity out over an area, with a tailored intensity distribution. The disclosure there emphasizes uniformity of the intensity distribution, for example with respect to angles extending over a hemispherical radiation pattern. Adjustment of the parameters of the constructive occlusion system enables the system designer to tailor the system performance to a wide range of applications.

However, a need still exists for radiant energy or electromagnetic emission and distribution systems, which can satisfy certain specialized requirements as to a desired intensity distribution. Such systems must be relatively simple in structure, to minimize cost and maximize durability. Also, such systems should be able to achieve a desired intensity distribution including at least some area beyond the horizon of the aperture, and in some instances exhibiting a dead zone at or near the horizon. In the gas station example, such a dead zone at or near the horizon would help to minimize light trespass on adjacent properties.

DISCLOSURE OF THE INVENTION

The invention addresses the above stated needs and overcomes the stated problems by providing a port and deflector structure on an optical-integrating cavity, preferably the cavity in a mask and cavity type constructive occlusion illumination system.

One aspect of the invention relates to a lighting system, comprising a diffusely reflective optical-integrating cavity and a source coupled to emit light into the cavity. An elongated port extends along a portion of a perimeter of the cavity. This port provides passage for light from within the cavity. The system includes two reflectors mounted along opposite edges of the port. Each reflector has a reflective surface extending at an angle from one elongated edge of the port toward a region to be illuminated. These reflective surfaces form a deflector, coupled to the port. In a circular system embodiment, for example, the deflector would fan around all or a part of the periphery of the circular cavity. One or more deflectors may fan or extend along the side(s) of a rectangular system. The deflector expands outward along its length as the surfaces extend toward a region to be illuminated. The deflector directs the light from within the cavity over the region to be illuminated.

The deflector surfaces may be formed on a variety of structures. For example, the reflectors may be formed on facing surfaces of two angled plates or on a surface of a solid base and an opposing surface of a plate. Alternatively, the deflector may utilize total internal reflection, in which case, the surfaces correspond to the boundaries between a transparent solid and the surrounding environment.

The preferred embodiments combine the port and deflector structure with the elements of a constructive occlusion illumination system. The constructive occlusion provides illumination for one region, and the port and deflector illuminate another region.

Another inventive aspect therefore relates to a system for projecting electromagnetic radiation with predetermined intensity over two distinct regions. The system includes a base, which has a defined area substantially facing a first region to be illuminated. This area of the base exhibits a reflective characteristic with respect to the electromagnetic radiation. Preferably, a shoulder is adjacent to and extends along a portion of the defined area of the base, although the shoulder may be omitted. If included, the surface of the shoulder, which faces toward at least a portion of the first region, has a reflective surface. The system further includes a mask between the base and the first region, at a predetermined distance from the defined area of the base. On the mask, an area substantially facing the defined area of the base also is reflective. A source emits electromagnetic radiation for reflection between the defined areas of the base and mask, such that the base, mask and shoulder provide a tailored intensity distribution of electromagnetic radiation over the first region to be illuminated. The system also includes a port and a deflector. The port extends through the base or the mask, from the defined area thereof toward a second region to be illuminated. The deflector has a reflective inner surface extending and expanding from a narrow end coupled to the port toward the second region. The regions may overlap, or one region may include the other. In certain preferred embodiments, the second region includes at least a substantial area that is outside the first region. In several of these embodiments, a dead zone that the system does not illuminate separates the two regions.

In the preferred embodiments, one of the defined areas comprises the aperture of a diffusely reflective cavity. The cavity therefore may be in the base or the mask, although often it is formed in the base.

The mask and cavity system may take a variety of different shapes. In many cases, these elements are circularly symmetrical about a common axis. For example, the cavity may take the form of a segment of a sphere, often approaching a hemisphere. The aperture is a flat, circular opening. The mask may be a flat disk, or the mask may contain a reflector surrounding the light source. In such cases, the preferred deflector forms a fan extending around at least a portion of the base.

In an embodiment of the system that is substantially symmetrical about the axis, the port and fan may actually encircle the system. For example, the port may take the form of an annular ring opening outward from a hemispherical cavity. In a rectangular embodiment, the cavity takes the form of a segment of a cylinder. In this example, there may actually be two ports extending in parallel along opposite sides of the cavity and two deflectors. Each deflector forms a straight fan along one side of the system. The invention also encompasses embodiments with additional ports and deflectors coupled to the base and/or the mask at various peripheral or elevational locations.

The inventive illumination system can provide desired intensity illumination over two or more different regions, which may be totally separated. In the gas station application, for example, one region illuminated by constructive occlusion would be under the canopy. The other region may actually be above the system on the underside of the canopy, to provide indirect illumination of vertical services within the service area. A dead zone between the two regions, created by the shoulder and a fan-shaped deflector structure, prevents radiation of energy out into areas around the horizon of the system, and thereby minimizes light trespass on properties adjacent to the service station.

The inventive systems provide desired intensity illumination over precisely defined systems, with little or no illumination in undesired areas. The use of highly reflective materials within the system together with the system structure serves to distribute virtually all of the radiant energy into the desired regions. As a result, the inventive systems also are highly efficient.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF DRAWINGS

The drawing figures depict the present invention by way of example, not by way of limitations. In the figures, like reference numerals refer to the same or similar elements.

FIG. 6 is a computer line drawing of a second preferred embodiment of a lighting system utilizing the principles of the invention, for example, for illumination under a canopy in a service station or the like.

FIG. 8 is a side view of the embodiment of FIG. 6.

FIG. 9 is a bottom plan view of the embodiment of FIG. 6.

FIG. 10 is a polar plot, and FIG. 11 is a graph, of intensity versus angle from the down axis, useful in explaining the performance of the system shown in FIGS. 6 to 9.

FIG. 12 is a front-side view of a wall-mount system utilizing the inventive concepts.

FIG. 13 is a cross-sectional view of the embodiment of FIG. 12 taken along line 13—13.

DETAILED DESCRIPTION OF THE PREFERRED EMBODIMENTS

The present invention utilizes an integrating cavity with a port and deflector along a portion of the perimeter of the cavity. Typically, the deflector is in the form of a "fan" extending along one side or around all or part of the circumference of the cavity. The preferred embodiments use principles of constructive occlusion (diffuse reflectivity in a mask and cavity structure) together with the port and deflector structure. To the port and deflector structure, the cavity and mask serve as the optical integrating cavity.

The constructive occlusion provides a tailored intensity distribution for radiant energy illuminating a first region. A reflective structure, typically expanding outward as it extends out from the port, serves as the deflector to distribute another portion of the electromagnetic energy over a second field of intended illumination. The first and second areas illuminated by such a system may overlap slightly, but preferably most of the two areas are separate. In several preferred embodiments a dead zone, which receives little or no radiant energy from the system, actually separates the two regions. The invention contemplates configurations of the system components to offer a variety of different intensity distributions in one or both of the fields of intended illumination. The invention also encompasses embodiments having one or more additional ports and deflectors to illuminate additional regions.

The combination of illumination by constructive occlusion in one region with port and deflector illumination of a separate region enables the designer to precisely tailor the illumination system to the needs of certain specific applications with little or no energy lost to irradiation of areas outside the intended fields of illumination. One particular example enables the designers to create a dead zone, so as to prevent light-trespass. In such a system, the energy that another type of system would direct into undesirable areas actually is redirected within the inventive system to illuminate the desired areas. Consequently, the inventive system provides particularly high efficiencies and enables the use of lower power and/or smaller or fewer sources of radiant energy to achieve the desired levels of illumination. The illuminating systems are relatively simple in design, making the inventive devices relatively cheap to manufacture as well as more durable than prior systems designed to meet similar application requirements.

Those skilled in the art will recognize that the principles of the present invention are applicable to distribution of various forms or wavelengths of radiant energy or electromagnetic radiation. The preferred embodiments relate to illumination with visible light, and the following discussion will concentrate on discussion of lighting systems, although clearly the invention encompasses radiation of other forms of electromagnetic energy.

Figure 1:
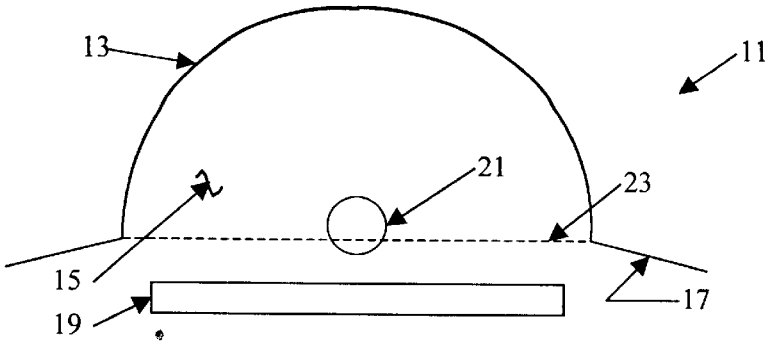
FIG. 1 is a cross-sectional view of a mask, cavity and shoulder type illumination system utilizing constructive occlusion, useful in explaining certain concepts of the present invention.

FIG. 1 depicts a first, simple embodiment of a light distributor apparatus or system 11, for projecting light with a tailored intensity distribution using the principles of constructive occlusion. In the illustration, the system 11 is oriented to provide downward illumination. Such a system might be mounted in or suspended from a ceiling or canopy or the like. Those skilled in the art will recognize that the designer may choose to orient the system 11 in different directions, to adapt the system to other lighting applications.

The light distributor 11 includes a base 13, having or forming a cavity 15, and an adjacent ring-shaped shoulder 17. A disk-shaped mask 19 is disposed between the cavity aperture 23 and the field to be illuminated. In this symmetrical embodiment, the aperture 23 is circular, and the shoulder 17 completely surrounds the aperture 23.

In many embodiments, the cavity 15 comprises a substantial segment of a sphere. For example, the cavity may be substantially hemispherical as shown. However, the cavity's shape is not of critical importance. A variety of other shapes may be used. For example, half-cylindrical cavities having a square or rectangular aperture or even having a nearly linear aperture with a narrow rectangular opening are contemplated for certain specific applications requiring a more rectangular illumination footprint in the region illuminated by the constructive occlusion technique. Practically any cavity shape is effective, so long as it has a diffuse reflective inner surface. A hemisphere is preferred for the ease in modeling its azimuthal symmetry and for its ease in construction. In the illustrated embodiment, the base and the shoulder are circular, although other shapes may be used.

The mask 19 is positioned between the base 13 and the target area, region or surface to be illuminated. As such, the mask 19 is outside of the cavity 15. For example, in the orientation shown, the mask 19 is below the aperture 23 of the cavity 15 in the base 13.

A source 21 emits electromagnetic radiation, for example as visible light, into the volume between the cavity surface and the facing surface of the mask. The system may include a variety of different types of sources, including light bulbs, one or more LEDs, and one or more optical fibers coupled to remote light generation components. In the example shown, the light source 21 is an idealized spherical source emitting radiation in virtually all directions.

In this first embodiment, the base 13, the shoulder 17 and the mask 19 preferably are formed of a suitable diffusely reflective material such as Spectralon®, which is a highly reflective polymeric material manufactured and sold by Labsphere, Inc., of North Sutton, N.H. This material is easily machined and very durable, and it provides a highly efficient Lambertian surface having a reflectance of more than 99%, for visible and near-infrared wavelengths. A Lambertian surface emits light with substantially uniform intensity in all directions. W. L. Gore & Associates offers a material with similar performance characteristics under the trademark Whitestar.

Alternatively, the base 13 and the mask 19 could be constructed of a suitable base material of, for example, aluminum or plastic, with a coating of a diffuse reflective material such as barium sulfate, Spectralon or Whitestar on the appropriate surfaces. Other suitable materials, though less effective than the diffuse reflective materials identified above, include quasi-diffuse reflective materials, such as gloss white paint. The use of such materials provides improved performance over prior light distributors.

The light source 21 emits light into the base cavity 15. The light source 21 also directs some light toward the mask 19, and the light source 21 may direct some light toward the shoulder 17. The light source 21 may emit some light directly through the gap between the aperture 23 and the mask 19. Light rays impacting on the diffusely reflective surfaces, particularly those impacting on the inner surface of the cavity 15 and the facing surface of the mask 19, reflect and diffuse one or more times within the confines of the system and eventually emerge through the gap between the perimeter of the aperture and the edge of the mask. The shoulder diffuses and reflects some of this light toward the field of intended illumination.

For purposes of constructive occlusion, the base 13 may be considered to have an active optical area, preferably exhibiting a substantially Lambertian energy distribution. Where the cavity is formed in the base, for example, the planar aperture 23 formed by the rim or perimeter of the cavity 15 forms the active surface with substantially Lambertian distribution of energy emerging through the aperture. As shown in a later embodiment, the cavity may be formed in the facing surface of the mask. In such a system, the surface of the base may be a diffusely reflective surface, therefore the active area on the base would essentially be the mirror image of the cavity aperture on the base surface, that is to say the area reflecting energy emerging from the aperture of the cavity in the mask.

In accord with the invention, the mask 19 constructively occludes a portion of the optically active area of the base with respect to the field of intended illumination. In the example of FIG. 1, the optically active area is the aperture 23 of the cavity 15; therefore the mask 19 occludes a substantial portion of the aperture 23, including the portion of the aperture on and about the axis of the mask and cavity system.

The relative dimensions of the mask 19 and aperture 23, for example the relative diameters or radii in the circular embodiment as well as the distance of the mask 19 away from the aperture 23, control the constructive occlusion performance characteristics of the light distributor system 11. Certain combinations of these parameters produce a relatively uniform intensity with respect to angles of emission, over a wide portion of the field of view about the system axis (vertically downward in FIG. 1), covered principally by the constructive occlusion. Other combinations of size and height result in a system performance that is uniform with respect to a wide planar surface perpendicular to the system axis at a fixed distance from the aperture.

The shoulder 17 also reflects at least some light downward. The angle of the shoulder and the reflectivity of the surface thereof facing toward the region to be illuminated by constructive occlusion also contribute to the intensity distribution over that region. In the illustrated example, the diffusely reflective shoulder 17 is angled somewhat downward from the plane of the aperture 23 toward the first region to be illuminated.

Figure 2:
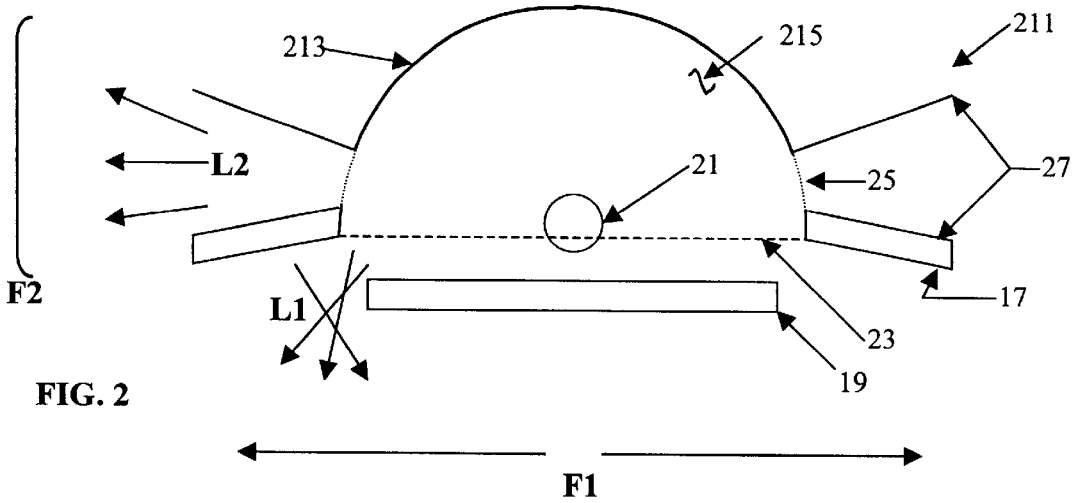
FIG. 2 is a cross-sectional view of a simple embodiment of an illumination system utilizing constructive occlusion in combination with a port and deflector structure, in accord with the principles of the present invention.

FIG. 2 is a cross-sectional view of a first embodiment of the invention, combining the constructive occlusion principles of the system of FIG. 1 with a port and a fan-like light distributor or deflector structure. The system 211 distributes light rays such as L1 over a first region or field F1 of intended illumination by constructive occlusion. The cavity and mask may be considered as a rough approximation of a spherical integrating cavity. This integrating cavity couples light to the port and deflector, which directs light rays such as L2 toward a second field or region F2 intended for illumination.

In the illustration, the system 211 includes a base 213 having or forming a cavity 215. If fully extended to the aperture 23, the cavity 215 would have essentially the same shape as the cavity 15 in system 11 (FIG. 1). Again, the ring-shaped shoulder 17 surrounds the aperture 23. For purposes of this discussion, the aperture 23 forms the active optical area with respect to the base 213. A disk-shaped mask 19 is disposed between the cavity aperture 23 and the first field F1 to be illuminated (downward in the illustrative orientation). As in the system 11, the inner surface of the cavity 215 and the facing surface of the mask 19 are diffusely reflective. The surface of the shoulder 17 facing toward a portion of the first region F1 is reflective, although it may be specular or diffusely reflective. These elements illuminate the first region F1 by constructive occlusion essentially as described above. The drawing shows limited examples L1 of the light rays produced by constructive occlusion to illuminate the first area F1.

In the system 211 of FIG. 2, however, the base 213 has one or more elongated ports 25. In this case, the port(s) 25 represent one or more openings from the cavity 215 outward and somewhat away from the first intended field of illumination. A deflector 27, preferably formed as a fan-shaped structure located along the port(s), directs light emerging from the cavity through the port(s) 25 toward the second region intended for illumination by the system 211.

Figure 2A:
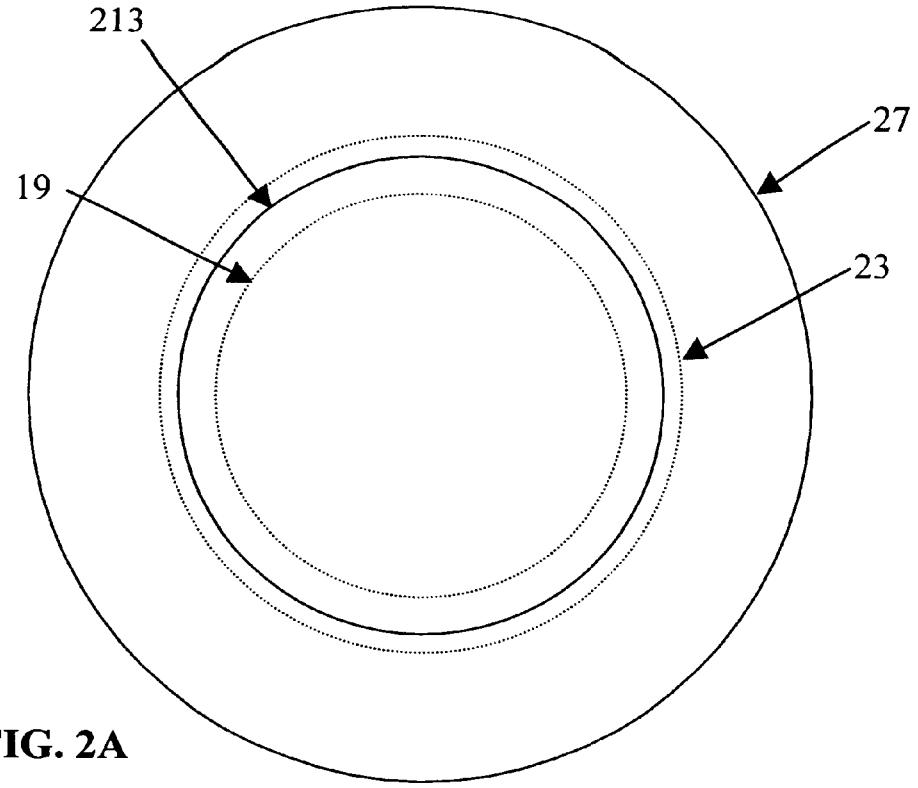
FIG. 2A is a top plan view of the illumination system of FIG. 2.

In the example illustrated in FIG. 2, assume that the cavity 215 is substantially hemispherical. The port 25 preferably takes the form of an annular opening in the shape of a ring around the cavity. In this example, the annular opening 25 is spaced a distance from the aperture 23, although later examples include embodiments wherein the port is substantially adjacent the aperture. FIG. 2A is a top plan view of the system of FIG. 2, showing the deflector fanning out around the system, so as to completely encircle the port formed around the perimeter of the base 213.

The port 25 allows some light processed within the cavity 215 to emerge outward in a different direction, separate and apart from the light processed and emitted downward by the constructive occlusion technique. Light passing through this port 25 enters a spreading or expanding-height deflector 27. Viewed in cross-section, on each side of the base 213, the exemplary deflector structure 27 has a cross-section similar to that of a cone with a straight angled wall. The narrow end of the inner surface of the deflector 27 is optically coupled to the port 25. The deflector 27 expands (in height in the illustrated orientation) as it extends from the port 25 toward the second area F2 of intended illumination.

Figure 2B:
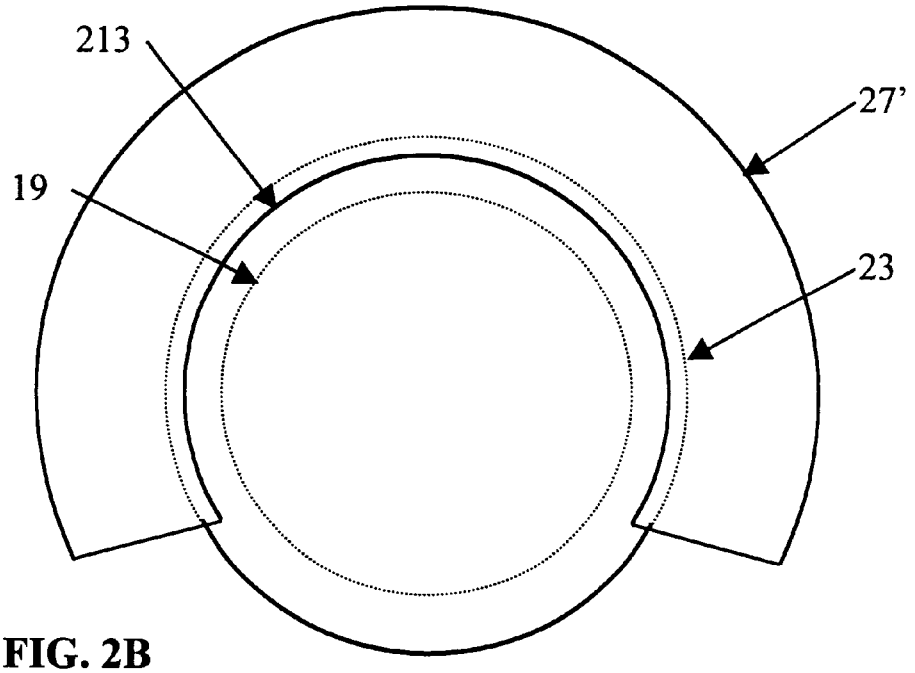
FIG. 2B is a top plan view of a system similar to that of FIG. 2 with a modified fan design for the deflector structure.

In this embodiment the port 25 and the associated fan-shaped deflector 27 completely encircle the base 213 and cavity 215 (see FIG. 2A). FIG. 2B shows a modified version of the deflector 27'. In that implementation, the deflector forms a fan only partially extending around the perimeter of the base 213. Although not visible in this view, the port typically would extend only part-way around the cavity.

In the illustrated example, the deflector essentially comprises two angled planar surfaces. The entire area of each of these surfaces is reflective. At least a portion of each reflective surface of the deflector 27 is specular. A specular, reflective material reflects light in such a manner that the angle of reflection of the redirected light with respect to the reflective surface has the same magnitude as the angle of incidence of the incoming light relative to that surface. However, the term "specular" covers a range of materials and reflectivities. A highly specular material has a mirror-like finish, for example formed by silver and glass coatings or formed of highly polished aluminum. A quasi-specular material will not reflect as efficiently as a highly specular material and may cause some diffusion of the light. However, most of the reflected light will satisfy the principle that angle of reflection equals angle of incidence. As an example, a quasi-specular surface may be formed of lightly polished aluminum.

Preferably, a substantial portion of each inner surface of the deflector 27 has a specular reflectivity. The entire surface may be uniformly specular (e.g., highly specular). Alternatively, one or more sections of the inner walls of the deflector may have a diffuse reflectivity or a different degree of specular reflectivity (e.g., quasi specular). The port 25 and the deflector 27 are dimensioned relative to a desired field of illumination such that the inner surface of the deflector 27 deflects light that would otherwise pass out of the desired second field of intended illumination within that desired field F2. Around its circumference, the fan-shaped deflector structure will direct or distribute light from the port 25, represented on the left side by the light rays L2, toward the second area F2 that the system 211 is designed to illuminate. The fan-shaped deflector 27 may provide a substantially uniform light intensity distribution over the second field of intended illumination F2.

In the illustrated example, the second area F2 illuminated through the port and distributor extends out toward and somewhat above the horizon of the system 211. Near the shoulder 17, the two fields of illumination F1 and F2 may not overlap. However, at substantial distances from the system, the two fields will overlap somewhat. It should be apparent, however, that despite the overlap the two fields of view of the system 211 actually illuminate two substantially different areas. The central portion of the first field of view is not illuminated by any light from the port 25 or the deflector 27. Instead that portion of the first field F1 is illuminated only by the constructive occlusion processing. Conversely, the portion of the second field F2 that extends substantially above the system horizon receives little or no light from the constructive occlusion illumination of the area F1.

Figure 3:
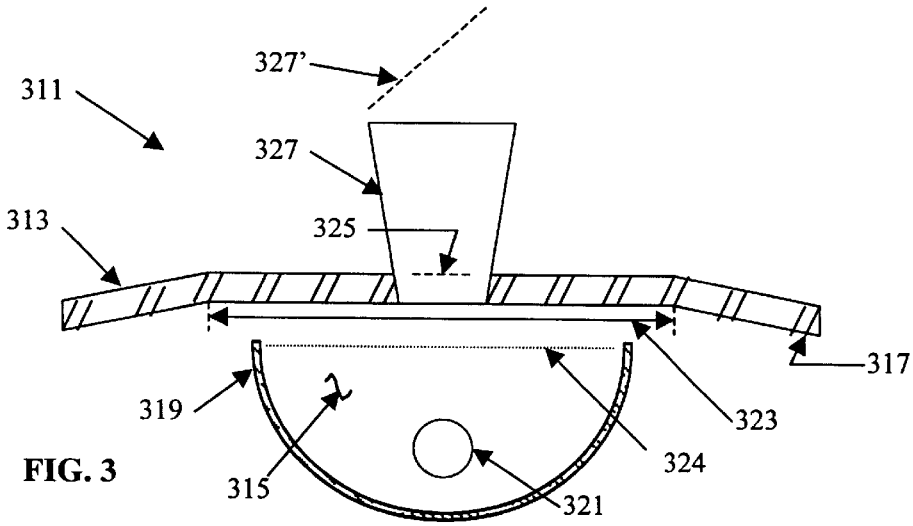
FIG. 3 is a cross-sectional view of another simple embodiment of an illumination system utilizing constructive occlusion in combination with a port and deflector structure, in accord with the principles of the present invention.

FIG. 3 illustrates another exemplary lighting system 311 embodying the principles of the present invention. The system 311 comprises a base 313, a mask 319, a light source 321 and a conical deflector 327. The system is circularly symmetrical about a vertical axis, although it could be rectangular or have other shapes. The base includes a flat central region 323 that is reflective and forms or contains the active optical area on the base facing toward the first region or area to be illuminated by the system 311.

The mask 319 is positioned between the base 313 and the region to be illuminated by constructive occlusion. For example, in the orientation shown, the mask 319 is below the active optical area 323 of the base 313.

In this embodiment, the mask 319 contains the diffusely reflective cavity 315. The aperture 324 of the cavity 315 and any diffusely reflective surface that may surround that aperture form the active optical area on the mask 319. Such an active surface faces toward the active surface 323 on the base 313. The surface 323 is reflective, preferably with a diffuse characteristic. The surface 323 of the base 313 essentially acts to produce a diffused mirror image of the mask 319 with its cavity 315 as projected onto the base surface 323. The surface area 323 reflects energy emerging from the aperture 324 of the cavity 315 in the mask 319. The mask 319 in turn constructively occludes light diffused from the active base surface 323 with respect to the first region illuminated by the system 311.

A source 321 emits electromagnetic radiation, for example as visible light, into the volume between the cavity surface and the facing surface 323 of the base. The system may include a variety of different types of sources, including light bulbs, one or more LEDs, and one or more optical fibers coupled to remote light generation components. In the example shown, the light source 321 is an idealized spherical source emitting radiation in virtually all directions.

The base 313 in the system 311 also includes a ring-shaped shoulder 317. The lower surface of the shoulder 317 is reflective, as in the earlier embodiments. Although the angle of the shoulder surface may be different for different applications, the angle shown is essentially the same as in the previous embodiments.

The light source 321 emits light into the mask cavity 315. The light source 321 directs some light toward the surface 323 on the base. The light source 321 may direct some light toward the shoulder 317. Although not shown, the light source 321 may emit some additional light directly through the gap between the mask 319 and the base 313. Light rays impacting on the diffusely reflective surfaces, particularly those on the inner surface of the cavity 315 and the facing surface 323 of the base 313, reflect and diffuse one or more times within the confines of the system and emerge through the gap between the perimeter of the active area 323 of the base and the edge of the mask 319. The light emitted through the gap and/or reflected from the surface of the shoulder 317 irradiates the first region with a desired intensity distribution, essentially as in the earlier embodiments.

The system 311 also includes a port 325 extending through the base 313, from the optically active area 323 toward a second region to be illuminated. In the illustrated example, the port 325 takes the form of a circular opening along the system axis. However, the port 325 may have other shapes, locations or orientations, in order to direct light from the source 321 and the volume between the base 313 and the mask 319 toward another desired area of illumination. For some applications, there may be two or more such ports 325 through the base 313.

The system 311 includes a deflector 327 coupled to the port 325. The deflector 327 has the shape of a truncated cone, in this embodiment, with a circular lateral cross section. The cone has two circular openings. Although not shown, the large opening may be covered with a transparent plate or lens, to prevent entry of dirt or debris through the cone into the system. The cone tapers from the large end opening to the narrow end opening, which is coupled to the port 325. The narrow end of the deflector cone receives light from the source 321 and from diffuse reflections between the base 313 and the mask 319.

The entire area of inner surface of the cone 327 is reflective. At least a portion of the reflective surface is specular. In the system of FIG. 3, for example, the specular surface within the conical deflector 327 may be quasi-specular or highly specular. Some portions, such as along the edge at the large opening, may exhibit other types of reflectivity. For purposes of further discussion of FIG. 3, it is assumed that the entire inner surface of the conical deflector 327 has a uniform specular reflectivity. The angle of the wall(s) of the conical deflector 327 substantially corresponds to the angle of the desired field of view of the illumination intended for the second region. Because of the reflectivity of the wall of the cone 327, most if not all of the light reflected by the surface would at least achieve an angle that keeps the light within the field of view.

In the illustrated example, the system 311 provides a tailored intensity illumination of a relatively large region below the base and mask. Depending of the system parameters, the intensity distribution may be substantially uniform over a range of angles, or the system may provide an intensity distribution having a substantial planar uniformity over a wide footprint. The elements may readily be adapted to provide other distributions over the first region of illumination, to meet a wide range of lighting system design criteria.

The conical deflector 327 and the port 325 enable the system to concurrently illuminate a separate, second region, over a relatively narrow range of angles. The size of the port 325 substantially determines the percentage of light directed toward the second region. The angle of the wall of the conical deflector 327 substantially determines the range of angles within the field of view and thus the size of the illumination footprint in the second region.

The conical deflector 327, with a specular inner surface provides a substantially uniform illumination within the limited field of view; however, other deflector shapes and reflectivities may be used to provide different intensity distributions and/or different illumination footprints in the second illuminated region. For example, if the desired footprint is not along the axis of the conical deflector 327, the deflector may further comprise an angled reflective surface or mirror 327. This additional deflector component directs the light emerging from the cone off in another direction, for example, to one side in the version shown.

Figure 4:
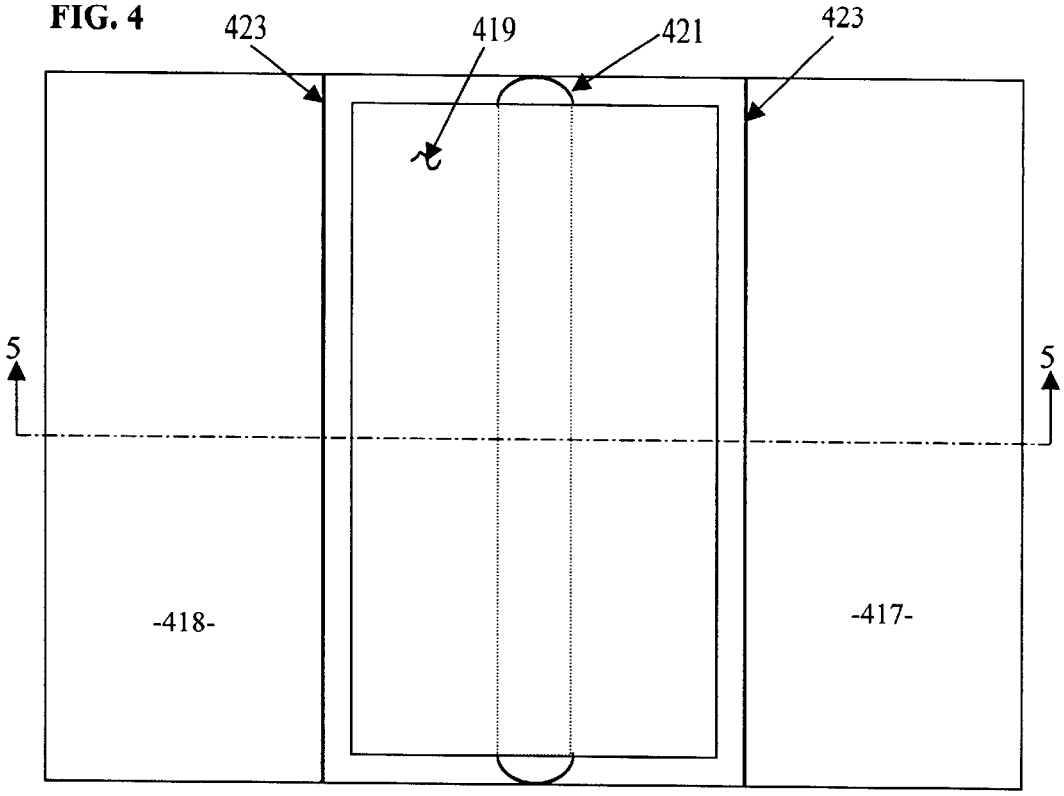
FIG. 4 is a plan view of a first preferred embodiment of a lighting system utilizing a mask, cavity and shoulder in combination with a pair of ports and deflector structures.
Figure 5A:
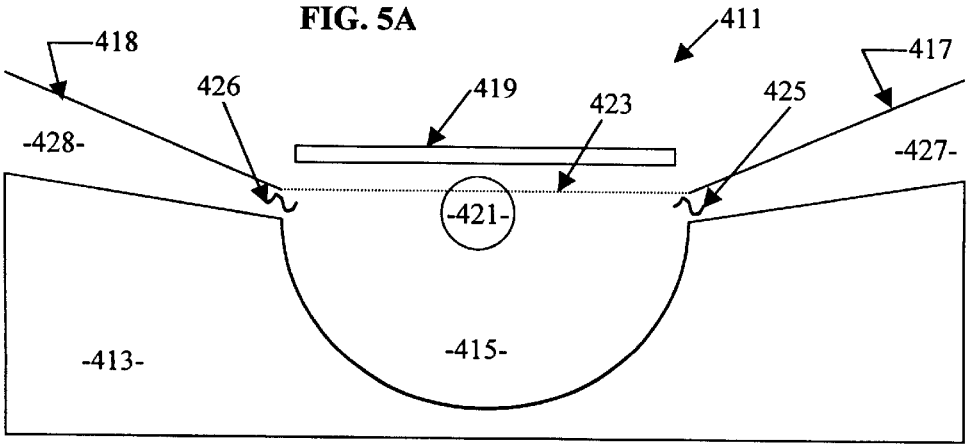
FIG. 5A is a cross-sectional view of the embodiment of FIG. 4 taken along line 5—5.

FIG. 4 is a plan view and FIG. 5A is a cross-sectional view of an embodiment of the principles of the invention in a first practical lighting system design application. This particular system 411 is optimized for providing an up-light illumination, albeit with a relatively high intensity in areas nearing the horizon to the right and left sides of the system. As in the earlier embodiments, the system 411 comprises a base 413. In this case, the base 413 has a diffusely reflective cavity 415. The cavity takes the form of a portion or segment of a cylinder, such as a half-cylinder with closed ends. Such a cavity presents a rectangular aperture toward the first area to be illuminated.

The illustrated version exhibits a relatively wide rectangular aperture. For some applications it may be desirable to lengthen the system and narrow the cavity and aperture such that the long narrow aperture approximates a nearly linear opening or slit.

In this embodiment, the ports 425, 426 are formed along respective boundaries between the sides of the cavity 415 and the shoulders 417, 418. Consequently, the inner edges of the shoulders 417, 418 actually define the aperture 423 for constructive occlusion purposes with respect to the first region intended for illumination by the system. This aperture 423 is said to be the aperture of the base-cavity 415 and define the active optical area of the base 413 essentially as if the sides of the cavity extended to the edges of the shoulders 417, 418 (without side ports 425, 426).

A mask 419 constructively occludes light diffused within the cavity from a source 421 and passing through a cavity aperture 423. The mask 419 has a diffusely reflective surface facing toward the aperture 423. In one actual implementation of this embodiment, the ratio of the dimensions, of the mask relative to the aperture, is 0.98.

This embodiment may be circular, or as shown, this embodiment may be rectangular. A rectangular version may approach a square, or the long dimension may be sufficiently longer than the narrow dimension that the aperture and mask become virtually linear in appearance.

In the illustrated implementation, the ends of the system above the base (top and bottom in the orientation of FIG. 4 or at the back when shown in the cross-section of FIG. 5A) are open. There could be a wall across one or both ends, or the shoulder and fan structures could extend around one or both ends, depending on the desired illumination around the ends of the system.

The first field to be illuminated is vertically above the system 411 in the orientation illustrated in FIG. 5A and is substantially centered about the vertical axis (180°). In this system 411, there are actually two shoulders 417, 418. The shoulders extend along the longer sides of the rectangular cavity near the sides of the aperture 423. Essentially, each shoulder is constructed of a flat plate mounted at the desired angle with respect to the plane of the aperture 423. The upper surface of each shoulder, facing a portion of the first intended field of illumination, has a light reflective characteristic. In the preferred form of this embodiment, the surface of each of the two shoulders 417, 418 is specular, although a diffuse reflectivity could be used on the shoulders.

The up-light system of FIGS. 4 and 5A includes two ports 425, 426 providing rectangular openings into the opposing sides of the partially cylindrical cavity 415. The system includes a deflector structure 427 coupled to the port 425 and a deflector structure 428 coupled to the port 426. The port 425 and the deflector structure 427 direct light from the cavity 415 toward the horizon on one side of the system (to the right in the drawings). Similarly, the port 426 and the deflector structure 428 direct light from the cavity 415 toward the horizon on the other side of the system (to the left in the drawings).

In the system of FIGS. 4 and 5A, the plates forming the shoulders 417, 418 together with upper surfaces of the base 413 form the two fan-shaped deflectors 427, 428, one of which is coupled to each of the elongated ports. The interior surfaces of the two fan-shaped deflector structures 427, 428 are substantially specular, as in the earlier embodiments. In the deflector 427, one specular surface is formed on the underside of the plate forming the shoulder 417, and the other specular surface of that deflector is formed on the top surface of the base 413. Similarly, in the deflector 428, one specular surface is formed on the top surface of the base 413, and the other specular surface of the deflector is formed on the underside of the plate forming the shoulder 418.

The light source 421 is a fluorescent lamp, that is to say in the form of an elongated tube. In this embodiment, the light source preferably is linear and extends along a substantial portion of the cavity, but other light sources could be used. For example, a remote lamp could transmit light to specific points along the cavity wall through a series of optical fibers coupled to openings through the base into the cavity or through the mask.

The source 421 could be positioned virtually anywhere so that its light passes into the space between the mask and cavity. However, it is preferred that the source 421 be located so that the source 421 transmits some portion of its light energy directly through the ports 425, 426 into the associated deflector structures 427, 428. The light source 421 may transmit some light directly through the ports and deflector structures into the respective fields of view. With the ports and deflectors located substantially as shown, the fluorescent lamp 421 should reside near the surface of the mask 421, to maximize the output into the second and third regions illuminated by the system.

With respect to the mask 419, the cavity aperture 423 appears to be a planar Lambertian diffusion surface or source. With respect to each port and fan-shaped deflector structure, the combination of the mask 419 and the cavity 415 forms an integrating cavity for efficiently coupling light from the source 421 through the respective port 425 or 426.

The port and fan structures provide relatively high-intensity illumination out toward the horizon of the system 411. The constructive occlusion provides a lower intensity illumination directly above the system. The constructive occlusion illumination extends outwards towards the horizon and to some extent overlaps the areas illuminated through the deflectors 427 and 428.

In the illustrated orientation, the system 411 does not provide any illumination downward (0°). The system begins to provide illumination only at angles approaching the horizon (90°). However, in the region just above the horizon, the deflector structure 427 or 428 provides a relatively high-intensity illumination, for example from approximately 95° to 125°. The illumination intensity tapers off to a more uniform level, provided by the constructive occlusion for angles ranging from about 145° to 180°(vertical).

The system 411 may be used as a "trougher" light, with a fluorescent lamp source, hanging down from but aimed up toward a ceiling. Actual illumination of an area by such a light relies on light bouncing down off of the ceiling. Because of the performance of the inventive design, the system 411 can provide superior lighting when hung as close as five inches below the ceiling. Prior trougher lights must be hung fifteen or more inches from the ceiling to obtain similar desirable results.

Figure 5B:
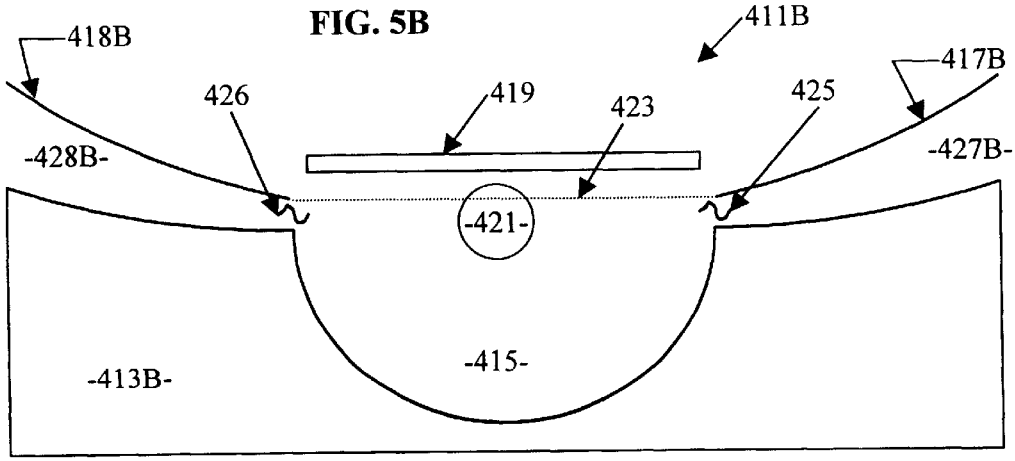
FIG. 5B is a cross-sectional view of an alternative embodiment of the system of FIG. 4, wherein the deflector has curved walls.

FIG. 5B illustrates an alternate cross-section of the system. The system 411B uses curved deflectors 427B, 428B. The cavity 415, the mask 419, the aperture 423, the lamp 421, and the ports 425, 426 are the same as the like-numbered elements in the system 411 of FIGS. 4 and 5A. The base 413B is essentially similar to the base 413, except that the upper surfaces on the sides of the cavity 415 curve upward as they extend out away from the ports 425, 426. These surfaces are reflective, preferably with a specular reflectivity, so as to function as part of the respective deflectors 427B and 428B.

In this system 411B, there are two shoulders 417B and 418B along the longer sides of the cavity 415 near the sides of the rectangular aperture 423. Essentially, each shoulder is constructed of an upwardly curved plate mounted at the desired angle with respect to the plane of the aperture 423. The upper surface of each shoulder, facing a portion of the first intended field of illumination, has a light reflective characteristic. In the preferred form of this embodiment, the upper surface of each of the two shoulders 417B, 418B is specular, although a diffuse reflectivity could be used on the shoulders. The lower surfaces of the curved plates 417B and 418B are substantially specular, as in the earlier embodiments.

The curvature of the plates forming the shoulders 417, 418 provides an added degree of structural strength and rigidity. The resulting curved deflectors 427B and 428B, however, provide substantially the same distribution of light over the respective fields of illumination as do the deflectors 427 and 428 in the preceding embodiment. The shoulders also function essentially as in the earlier embodiment of FIG. 5A.

Figure 5C:
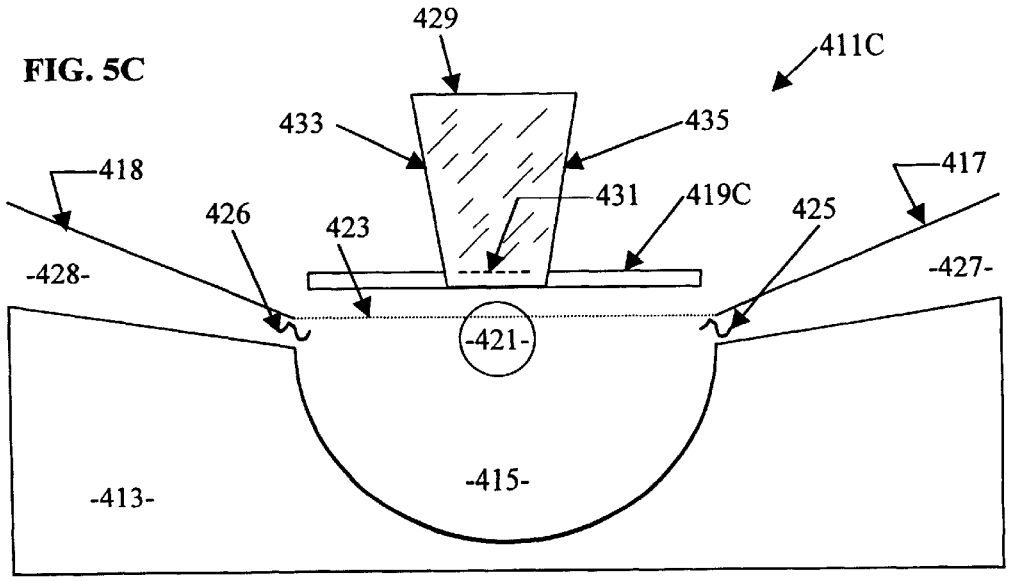
FIG. 5C is a cross-sectional view of system similar to that of FIGS. 4 and 5A but with the addition of a totally internally reflective deflector coupled to a port through the mask.

FIG. 5C illustrates an alternative embodiment 411C of the up-light. The cavity 415, the aperture 423, the lamp 421, the shoulders 417, 418, the ports 425, 426, and the deflectors 427, 428 are the same as the like-numbered elements in the system 411 of FIGS. 4 and 5A. The system 411C, however, includes an additional deflector 429 coupled to a third port 431. Although the port 431 could extend through the base and provide an optical coupling to the cavity 415, in this example, the port 431 extends through the mask 419C. The deflector 429, in turn, extends outward from a defined area of the mask 419C (in this case the reflective surface facing the aperture) toward another field intended for illumination.

The embodiment of FIG. 5C illustrates a number of additional inventive concepts. The port 431 and the deflector 429 provide a direct illumination of a portion of the light from the lamp 421 toward a desired area of illumination. The system 411C provides distinct illumination of four different areas or fields. The first area is illuminated by the constructive occlusion processing. The second and third areas are illuminated via the ports 425, 426 and the deflectors 427, 428; whereas light from the port 431 and the deflector 429 illuminates a fourth area. The area illuminated via the port 431 and the deflector 429, however, actually is contained entirely within the first area illuminated by the constructive occlusion processing.

The deflector 429 could take a number of different forms. In a circular system, the deflector 429 could take the form of a truncated, straight-sided cone having a substantially specular reflectivity on its inner surface, similar to the deflector 327 shown in FIG. 3. In such a case, the port 431 would be circular.

In the embodiment illustrated in FIG. 5C, however, the port 431 would be elongated, either to form a rectangle or to form an elongated oval (straight-sided but with rounded ends). Assume for the moment that the port 431 is an elongated rectangle. In such a case, the deflector could comprise two plates having opposing surfaces with a specular reflectivity.

As shown, the embodiment of FIG. 5C uses a solid deflector 429 and relies on total internal reflectivity. The deflector 429 consists essentially of a solid piece of transparent material, such as Acrylic or glass, constructed in such a manner that the light passing therethrough is totally internally reflected. Internally, such a solid is relatively transparent, but each boundary interface between the material and the surrounding environment functions as a substantially specular reflective surface. Hence, it should be understood by those skilled in the art that utilizing a solid piece of transparent material for the deflector 429 constructed so that there is total internal reflection results in the surfaces 433 and 435 of such material being equivalent to the reflective surfaces of the other deflectors, such as those of the deflectors 427 and 428.

Figure 6:
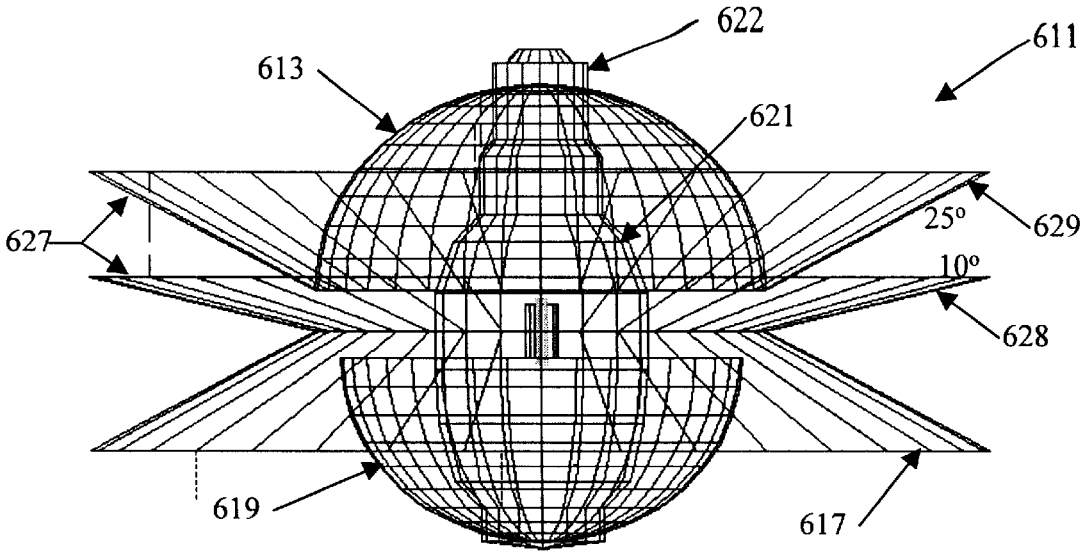
Figure 7:
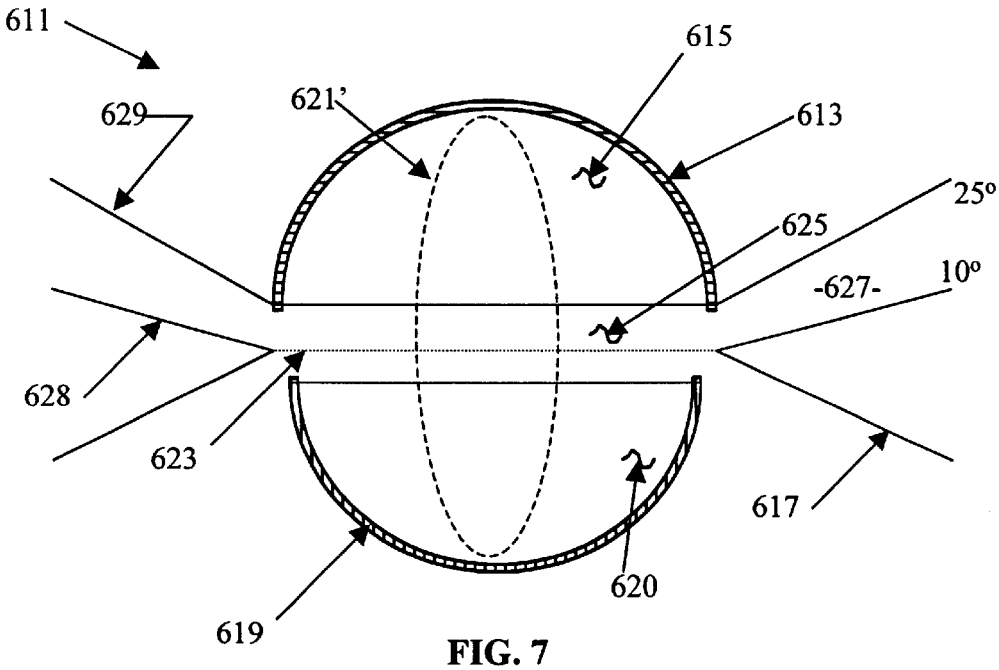
FIG. 7 is a cross-sectional view of the embodiment of FIG. 6.

FIG. 6 is a computer line drawing, FIG. 7 is a partial cross-section view, FIG. 8 is a side view, and FIG. 9 is a bottom plan view, of another preferred embodiment of the invention. This embodiment is particularly useful in certain under-canopy type lighting applications, for example to provide illumination under the canopy of a service station.

This embodiment comprises two opposing domes 613 and 619 of slightly different diameters supported at a distance from each other. Each dome may be substantially hemispherical. The inner surfaces of the domes 613, 619 are diffusely reflective, as in the earlier embodiments. The upper dome 613 forms the base and is slightly larger in horizontal diameter than the lower dome 619, which forms the mask for constructive occlusion purposes. The inner surface of the upper dome 613 forms a reflective cavity 615 in the shape of a segment of a sphere. The reflective interior 620 of the lower dome 619 could be considered as a cavity (similar to FIG. 3), but for purposes of discussion here we will refer to the reflective interior region 620 as a reflector surrounding a portion of the light source.

A metal halide lamp 621 mounted between the inner surfaces of the domes serves as the light source. An electrical connector 622 extends through an opening in the upper dome 613 and provides a coupling for the metal halide lamp 621 to an appropriate power source (not shown).

The mask 619 takes the form of a second dome forming a reflector or second cavity 620 mainly to accommodate the size and shape of the preferred lamp, i.e. the metal halide lamp 621 (FIG. 6) at the location shown diagrammatically by the dotted-line oval 621' in the cross-section view of FIG. 7. The system 611 may use the dome-shaped mask, a smaller dome or even a flat disk-shaped mask, if the designer elects to use a different type or size of light source. The combination of the cavity 615 and the deflector 620, within the domes, closely approximates a spherical optical integrating cavity.

The system 611 also comprises three angled, circular plates 617, 628 and 629 mounted to encircle the two domes 613, 619 as shown. Each angled plate takes the form of a truncated, straight-sided cone. The cone formed by the lower plate 617 has its broad end down. The cone of the plate 628 has its broad end upward as does the cone of the plate 629. The sidewall of the cone of the plate 628 preferably has a 10° angle relative to horizontal, and the sidewall of the cone of the plate 629 preferably has a 25° angle relative to horizontal.

The lower or inner surface of the plate 617 is reflective and serves as the shoulder formed about the constructive occlusion aperture 623 of the system 611. The upper or inner surface of the plate 628 is reflective and serves as one wall of the expanding fan-shaped deflector 627. The lower or inner surface of the plate 629 is reflective and serves as the other wall of the expanding fan-shaped deflector 627. The reflective shoulder surface of the plate 617 preferably is specular, although materials providing a diffuse reflectivity or other type of reflectivity could be used on that surface. At least a substantial portion of each of the reflective surfaces of the deflector 627 has a specular reflectivity. Some sections of those surfaces may have a different reflectivity, such as a diffuse reflectivity adjacent the outer ends of the surfaces, for certain applications.

The junction between the plates 617 and 628 forms the aperture 623. The space between that boundary and the lower edge of the plate 629 forms an annular port 625 formed in the wall of the base 613 to provide the optical coupling of the cavity 615 to the deflector 627. In this embodiment, annular port 625 is adjacent to the aperture 623. This position for the port is preferred, for ease of construction, but the annular pot could be at any elevation on the dome forming the base 613 and cavity 615, to facilitate illumination of a second field or region at a particular angular range relative to the system 611.

In this embodiment, the port 625 is formed along the boundary between the edge of the cavity 615 and the shoulder 617. Consequently, the inner edge of the shoulder 617 actually defines the aperture 623 for constructive occlusion purposes with respect to the first region intended for illumination by the system. The aperture 623 is said to be the aperture of the base-cavity 615 and define the active optical area of the base 613 essentially as if the sides of the cavity 615 extended to the edges of the shoulder 617 (without the port).

Hence the cavity 615, the aperture 623, the mask 619 and the shoulder 617 provide constructive occlusion processing of a first portion of the light from the source 621. The light emitted as a result of such processing provides a tailored intensity distribution for illumination of a first region, which is below the system 611 in the orientation shown. The relative dimensions of the aperture and mask, the distance of the mask from the aperture and size and angle of shoulder 617 determine the intensity distribution in this region, as in the earlier embodiments.

With respect to the port 625, the diffusely reflective surfaces 615 and 620 inside the two domes 613 and 619 together approximate an optically integrating sphere. The integrating sphere processes light from the internal source 621 and provides an efficient coupling of such light through the port 625.

The fan-shaped deflector 627 directs light emerging through the port 625 upward, away from the first (downward) field of intended illumination. In the illustrated example, the plates 628 and 629 form a limited second field of view for angles roughly between 10° and 25° above the horizontal. When measured with respect to the downward illumination axis of the system 611 as is used in lighting industry standards, this second field of illumination encompasses angles between 100° and 115°. Although some light passing through the port 625 is still directed outside the field of view defined by the deflector walls 628, 629, the reflective surfaces of the deflector 627 do channel most of the light from the port 625 into the area between the angles formed by those walls. As a result, the maximum intensity in the second illuminated region is between the angles defining the field of view of the deflector 627.

In this embodiment, the fan-shaped deflector structure is angled so as to direct light away from the field illuminated by constructive occlusion. The two illuminated regions do not overlap at all. The plates 617 and 628 create a dead zone of no illumination between the two regions.

In use, the system 611 is mounted or hung under a canopy. The mounting may place the upper edge of the upper angled plate 629 of the deflector 627 at the surface of the underside of the canopy or a few inches below that surface.

FIG. 10 is a polar plot, and FIG. 11 is a graph, of angle versus intensity showing the light distribution produced by the system 611. In either illustration, the 0° angle represents the direction directly down along the vertical axis of the system 611. The system 611 emits approximately 60% of the light energy upward, via the port 625 and the fan-shaped deflector structure 627. The system 611 emits approximately 40% of the light downward, as processed by constructive occlusion. The emissions upward are separated from the downward emissions by a large dead zone around the horizon (90°). The dead zone prevents direct illumination of adjacent areas, for example on a nearby highway or in a house next-door to the gas station.

Because of the structure of the system, the light that otherwise would emerge undesirably in the dead zone is kept within the system and reprocessed by the reflective surfaces of the system, until it emerges into one or the other of the two desired fields of illumination. The system 611 therefore provides the desired lighting performance with a particularly high degree of efficiency.

The lighting system structure illustrated in FIGS. 6–9 is round and symmetrical about a vertical system axis. For other applications, the design could be made rectangular or even linearized, in a manner similar to the embodiment of FIG. 4.

In the embodiments discussed above, the systems have provided lighting in a symmetrical fashion on both sides of the system. Such constructions are appropriate for many down-lighting and up-lighting applications, where the system is mounted below a ceiling or canopy or mounted on a pole or other support in an open area. The concepts of the invention also encompass variations on the disclosed structures modified or "cut in half" by a reflective surface to facilitate wall mounting thereof.

Figure 14:
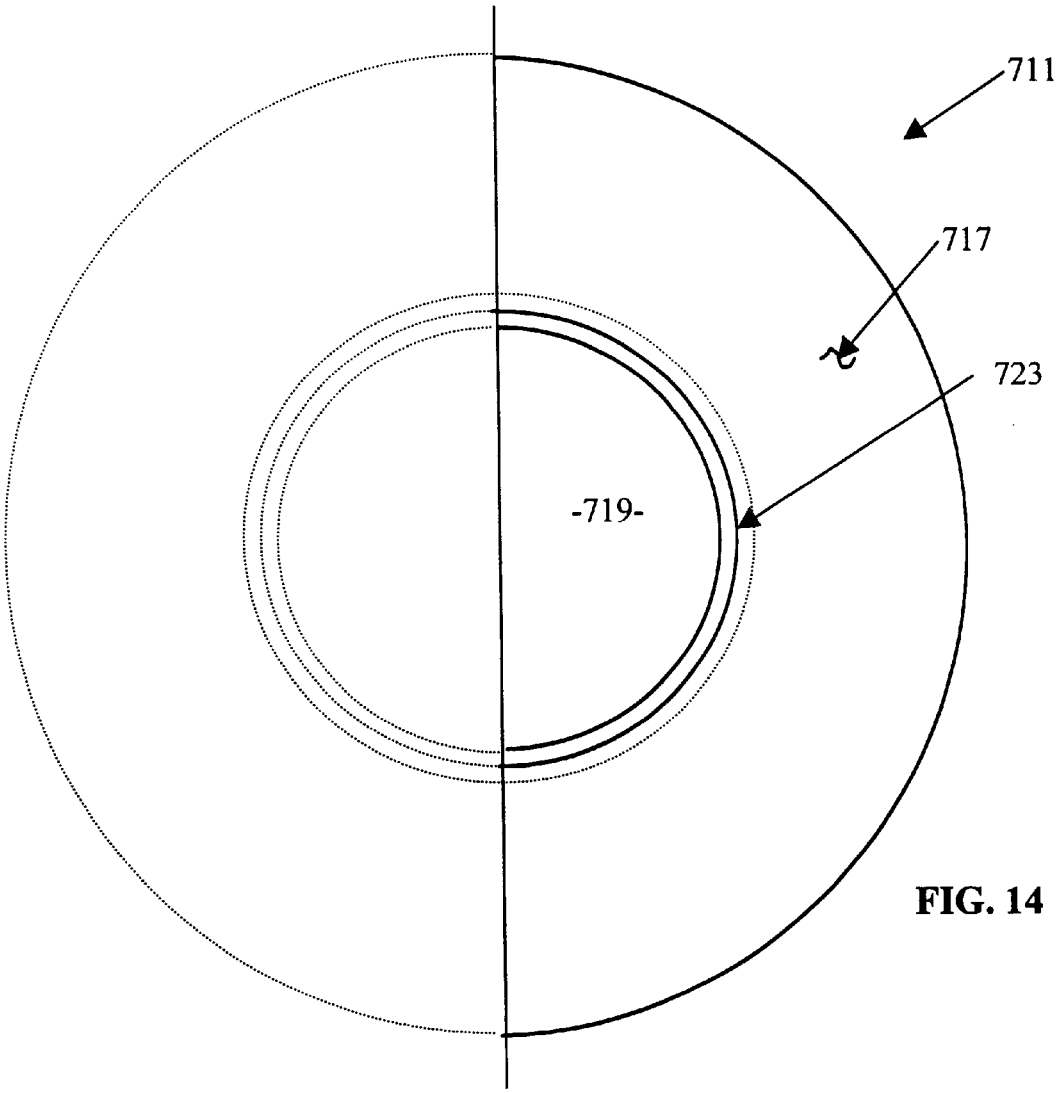
FIG. 14 is a bottom plan view of the system of FIGS. 12 and 13.

To illustrate this principle, FIGS. 12 to 14 relate to a cut-off version of the inventive system providing performance similar to that of the system of FIGS. 6 to 9. FIG. 12 provides a front-side view of the wall-mounted system 711. FIG. 13 is a cross-section of the system 711 taken along line 13—13 of FIG. 12; and FIG. 14 is a bottom plan view of the system.

This embodiment comprises two opposing half-domes 713 and 719 of slightly different diameters supported at a distance from each other. The back or cut-off side of each of the domes 713, 719 abuts a surface of a reflective wall 730.

The inner surfaces of the domes 713, 719 are diffusely reflective, as in the earlier embodiments. Within the domes, the surface of the wall 730 may be specular but preferably is diffusely reflective. The areas of the wall 730 outside the domes may have other reflectivities but preferably are specular.

The upper dome 713 forms the base and is slightly larger in size than the lower dome 719, which forms the mask for constructive occlusion purposes. The inner surface of the upper dome 713 forms a reflective cavity 715 in the shape of approximately a quarter-segment of a sphere. The reflective interior 720 of the lower dome 719 could be considered as a cavity (similar to FIG. 3), but for purposes of discussion here we will refer to the reflective interior region 720 as a reflector surrounding a portion of the light source. The reflector 720 also may take the shape of approximately a quarter-segment of a sphere. Although not shown in detail, the light source would be positioned approximately as shown by the dotted line at 721 in FIG. 13. The source may be a florescent lamp, a metal halide lamp or other convenient source of radiant light energy.

The system 711 also comprises three angled, half-circular plates 717, 728 and 729 mounted to extend from the wall 730 around the two domes 713, 719 as shown. Each angled plate takes the forms half of a truncated, straight-sided cone. The lower or inner surface of the plate 717 is reflective and serves as the shoulder formed about the outer portion of the constructive occlusion aperture 723 of the system 711. The upper or inner surface of the plate 728 is reflective and serves as one wall of the expanding fan-shaped deflector 727. The lower or inner surface of the plate 729 is reflective and serves as the other wall of the expanding fan-shaped deflector 727. The reflective shoulder surface of the plate 717 preferably is specular, and at least a substantial portion of each of the reflective surfaces of the deflector 727 has a specular reflectivity.

The junction between the plates 717 and 728 forms the aperture 723. The aperture 723 is said to be the aperture of the base-cavity 715 and define the active optical area of the base 713 for constructive occlusion purposes essentially as if the sides of the cavity 715 extended to the edges of the shoulder 725 (without the port).

When viewed looking toward the reflective wall 730, the system 711 looks essentially the same as the system 611 of the earlier embodiment (compare FIG. 8). When viewed from below and somewhat to the right, the mirror-imaging of the system in the surface of the wall 730 makes the system appear as a full-circular system as in the earlier embodiment (with the dotted line half-portions appearing as mirror images within the wall). The light intensity distributions over the two illuminated regions produced by the system 711 are similar in profile to those produced by the system 611 except that they extend only to the right in the orientation shown (FIGS. 13, 14). Assuming that the source produces the same amount or intensity of light for processing within the system 711, the distributions produced over the one-sided regions will be approximately double the magnitude of the intensities produced by the fully circular system 611.

The cavity 715, aperture 723, mask 719 and shoulder 717 provide constructive occlusion processing of a first portion of the light from the source 721. The light emitted as a result of such processing provides a tailored intensity distribution for illumination of a first region, which is below the system 711 in the orientation shown. The relative dimensions of the aperture and mask, the distance of the mask from the aperture and size and angle of shoulder 717 determine the intensity distribution in this region. The reflectivity of the wall 730 essentially produces a mirror image of the physical elements of the system 711, as shown in dotted line in FIGS. 13 and 14. Consequently, the system operates essentially as if it included the full circular components as in the preceding embodiment but reflects all of the light outward from the wall (to the right in FIG. 13). This causes the system to distribute light in the first field of illumination with essentially the same profile as the earlier system but with almost double the intensity thereof because light that would emerge to the left is now reprocessed and directed downward to the right.

The space between the boundary of the plates 717 and 728 and the lower edge of the plate 729 forms an annular port 725 formed in the wall of the base 713 to provide the optical coupling of the cavity 715 to the deflector 727. In this embodiment, the annular port 725 is adjacent to the aperture 723, although the annular port could be at any elevation on the cavity 715, to facilitate illumination of a particular field through the deflector 727.

With respect to the port 725, the diffusely reflective surfaces 715 and 720 inside the two domes 713 and 719 and the mirror-image reflections thereof by the surface of the wall 730 together form the equivalent of an optically integrating sphere. These optically integrating components process light from the internal source 621 and couple a substantial portion thereof through the port 725. Because of the mirror-image effect of the wall 730, the light emerging through the half-circular port 725 is almost double that emerging through the full circular port 625 in the preceding embodiment.

The fan-shaped deflector 727 directs light from the port 725 upward, away from the first (downward) field of intended illumination. Assuming that the plates 728 and 729 form a limited second field of view for angles roughly between 10° and 25° above the horizontal as in the earlier embodiment, the deflector 727 produces a similar intensity distribution over the second field of view, albeit doubled and covering only the half circular distribution to the right in the orientation of FIG. 13. In particular, the fan structure provides a high intensity illumination over the second field of illumination that is separated from the first field of illumination by a substantial dead zone, as in the preceding embodiment.

In the illustrated example, the domes 713, 719 and the wall 730 are separate elements, and the edges of the domes make relatively sharp corners where they abut the wall. Those skilled in the art will recognize that such a structure is somewhat idealized, for purposes of explanation. An actual implementation might involve formation of two or more of these elements from one common piece of material. In such an implementation, the corners, particularly those within the cavities would be rounded rather than the sharp corners illustrated. The system, however, would still perform substantially as discussed above.

Those skilled in the art will recognize that the inventive concepts disclosed above may be embodied in a variety of different practical structures to meet the lighting requirements of a wide range applications. For example, the size, shape and orientation of the cavities, the masks, the shoulders, the ports and the deflectors can be changed as needed to provide desired distribution of light over different footprints in each region illuminated. In some cases, to increase intensity in all or a part of one of the regions, a reflective "kicker" can be added in the form of a cone or baffle within the cavity of the system. Such a device tends to force more light out into a particular range of angles illuminated by the system.

Also, many of the deflectors have been shown with open ends projecting towards the desired fields of illumination. Although not shown, some applications may utilize a transparent cover over either the inner opening (at the port) or the outer opening of the deflector. Other applications may utilize some form of prism or lens at one or the other end of the deflector or at both ends of the deflector.

Furthermore, it may be desirable to have various combinations of multiple deflectors, such as one large deflector near the aperture and one or more smaller deflectors. Other applications may use fan deflectors at different elevations and/or angles coupled to the cavity and/or through the mask.

While the foregoing has described what are considered to be preferred embodiments of the invention it is understood that various modifications may be made therein and that the invention may be implemented in various forms and embodiments, and that it may be applied in numerous applications, only some of which have been described herein. It is intended by the following claims to claim all such modifications and variations which fall within the true scope of the invention.

What is claimed is:

1. A lighting system, comprising:

a diffusely reflective optical-integrating cavity;

a source coupled to emit light into the cavity;

an elongated port extending along a portion of a perimeter of the cavity, for providing a passage for light from within the cavity;

a first reflector mounted along the portion of the perimeter of the cavity, the first reflector having a reflective surface extending at a first angle from a first elongated edge of the port toward a region to be illuminated;

a second reflector mounted along the portion of the perimeter of the cavity, the second reflector having a reflective surface extending at a second angle from a second elongated edge of the port toward the region to be illuminated;

the reflective surfaces of the first and second reflectors forming a fan-shaped deflector coupled to the port and expanding outward as the reflective surfaces extend from the edges of the port toward the region to be illuminated, for directing the light from within the cavity over the region to be illuminated.

2. A lighting system as in claim 1, wherein the diffusely reflective optical-integrating cavity approximates an integrating sphere.

3. A lighting system as in claim 1, wherein the diffusely reflective optical-integrating cavity comprises two semi-spherical domes having diffusely reflective inner surfaces.

4. A lighting system as in claim 1, wherein the diffusely reflective optical-integrating cavity comprises two quarter-spherical domes having diffusely reflective inner surfaces and a reflective wall abutting edges of the domes.

5. A lighting system as in claim 1, wherein the diffusely reflective optical-integrating cavity comprises a base, a mask and a diffusely reflective cavity formed in the base or the mask configured to provide constructive occlusion illumination of another region.

6. A lighting system as in claim 1, further comprising:

another port for providing a passage for light from within the cavity; and another deflector coupled to said another port for directing light from said another port over another region to be illuminated.

7. A lighting system as in claim 6, further comprising:

a third port for providing a passage for light from within the cavity; and a third deflector coupled to said third port for directing light from said third port over a third region to be illuminated.

8. A lighting system, comprising:

a cavity having a diffusely reflective inner surface and an aperture;

a light source coupled to the cavity, for emitting light into an area within the cavity;

a mask positioned outside the cavity at a distance from the aperture, the mask having a reflective surface optically facing the aperture, the mask constructively occluding the aperture of the cavity with respect to a first field of intended illumination, such that light reflected between the mask and cavity and emerging from a gap between the mask and the aperture illuminates a substantial portion of the first field of intended illumination with a desired intensity distribution pattern;

a port extending from the diffusely reflective inner surface of the cavity toward a second field of intended illumination; and a reflector optically coupled to the port, for directing light emerging through the port toward the second field of intended illumination.

9. A lighting system as in claim 8, wherein the second field of intended illumination includes a substantial area outside the first field of intended illumination.

10. A lighting system as in claim 8, wherein the second field of intended illumination includes portion of the first field of intended illumination.

11. A system for projecting electromagnetic radiation with predetermined intensity over two distinct regions, comprising:

a base having a defined area substantially facing a first region to be illuminated with the electromagnetic radiation, the defined area of the base having a reflective characteristic with respect to the electromagnetic radiation;

a shoulder adjacent to and extending along a substantial portion of the defined area of the base, the shoulder having a surface with a reflective characteristic with respect to the electromagnetic radiation facing toward at least a portion of the first region to be illuminated;

a mask between the base and the first region to be illuminated at a predetermined distance from the defined area of the base, said mask having a defined area substantially facing the defined area of the base, the defined area of the mask having a reflective characteristic with respect to the electromagnetic radiation;

a source configured to emit the electromagnetic radiation for reflection between the defined areas of the base and mask, such that the base, mask and shoulder emit a substantial first portion of the electromagnetic radiation with a tailored intensity distribution of electromagnetic radiation over the first region to be illuminated;

a port providing a radiation coupling from one of the defined areas toward a second region to be illuminated with the electromagnetic radiation; and a deflector having at least one reflective inner surface extending from a narrow end of the deflector coupled to the port to a wide end of the deflector directed toward the second region to be illuminated, such that a second portion of the electromagnetic radiation emerging through the port and deflector illuminates the second region.

12. A system as in claim 11, wherein the second region to be illuminated includes a substantial area outside the first region to be illuminated.

13. A system as in claim 11, wherein the second region to be illuminated includes a portion of the first region to be illuminated.

14. A system as in claim 11, wherein the second region to be illuminated is located entirely within the first region to be illuminated.

15. A system as in claim 11, wherein the defined area of the base comprises an aperture of a diffusely reflective cavity formed in the base.

16. A system as in claim 11, wherein the defined area of the mask comprises an aperture of a diffusely reflective cavity formed in the mask, and the defined area of the base comprises an area reflecting electromagnetic radiation emerging from the cavity through the aperture.

17. A system as in claim 11, wherein the surface of the shoulder is inclined at an angle from the defined area of the base toward the first region to be illuminated.

18. A system as in claim 11, wherein the deflector directs the second portion of the electromagnetic radiation away from the first region to be illuminated such that the shoulder and the deflector create a dead zone of little or no illumination by the system between the first and second regions.

19. A system as in claim 11, wherein:

the port comprises an elongated opening extending along at least a portion of the periphery of the base; and the deflector forms a fan-shaped structure extending along the elongated opening.

20. A system as in claim 11, wherein the port extends from the defined area of the base toward the second region to be illuminated.

21. A system as in claim 11, wherein the port extends from the defined area of the mask toward the second region to be illuminated.

22. A system for projecting electromagnetic radiation, comprising:

a source emitting the electromagnetic radiation;

a base comprising a cavity optically coupled to receive the electromagnetic radiation from the source, the cavity having an inner surface with a substantially diffuse reflective characteristic with respect to the electromagnetic radiation and having an opening, a perimeter of the opening of the cavity forming an aperture substantially facing a first region to be illuminated with a first portion of the electromagnetic radiation;

a shoulder adjacent to and extending along a substantial portion of the aperture, the shoulder having a surface with a reflective characteristic with respect to the electromagnetic radiation facing toward at least a portion of the first region to be illuminated;

a mask between the base and the first region to be illuminated at a predetermined distance from the aperture, the mask having a surface area substantially facing the aperture which has a reflective characteristic with respect to the electromagnetic radiation, the mask having a relationship to the aperture such that the mask, cavity and shoulder provide a tailored intensity distribution of the first portion of the electromagnetic radiation over the first region;

a port extending through the base from the cavity toward a second region to be illuminated with a second portion of the electromagnetic radiation, the second region including a substantial area outside the first region to be illuminated; and a deflector, having a reflective inner surface, extending from a narrow end coupled to the port to a wide end directed toward the second region to be illuminated.

23. A system for projecting electromagnetic radiation as in claim 22, wherein the source comprises a visible light source.

24. A system for projecting electromagnetic radiation as in claim 22, wherein at least a portion of the surface of the shoulder exhibits a substantially diffuse reflective characteristic.

25. A system for projecting electromagnetic radiation as in claim 22, wherein at least a portion of the surface of the shoulder exhibits a substantially specular reflective characteristic.

26. A system for projecting electromagnetic radiation as in claim 22, wherein the surface area of the mask substantially facing the aperture has a substantially diffuse reflective characteristic.

27. A system for projecting electromagnetic radiation as in claim 22, wherein at least a substantial portion of the inner surface of the deflector has a substantially specular reflective characteristic.

28. A system for projecting electromagnetic radiation as in claim 22, wherein the port and deflector are directed at such an angle away from the first region to be illuminated as to create a dead zone of substantially no illumination by the system between the first and second regions to be illuminated.

29. A system for projecting electromagnetic radiation as in claim 22, wherein the cavity is substantially hemispherical, and the port comprises an annular opening extending around the hemispherical cavity about an axis through the cavity, the aperture and the mask.

30. A system for projecting electromagnetic radiation as in claim 29, wherein the deflector forms a fan structure encircling the annular opening.

31. A system for projecting electromagnetic radiation as in claim 22, wherein the mask comprises a curved reflector for reflecting light from the source substantially toward the cavity.

32. A system for projecting electromagnetic radiation as in claim 31, wherein the source comprises a lamp mounted within a volume substantially enclosed by the cavity and the curved reflector.

33. A system for projecting electromagnetic radiation as in claim 22, further comprising:

another port extending through the base from the cavity toward a third region to be illuminated with a third portion of the electromagnetic radiation; and another deflector having a reflective inner surface extending from a narrow end coupled to the other port to a wide end directed toward the third region to be illuminated.

34. A system for projecting electromagnetic radiation as in claim 33, wherein:

the port comprises an elongated opening along a first side of the cavity; and the other port comprises an opening along a second side of the cavity substantially opposite the first side of the cavity.

35. A system as in claim 34, wherein each of the deflectors comprises a fan-shaped structure constructed along one of the elongated openings.

36. A system as in claim 34, wherein the inner surface of the cavity comprises a segment of a cylinder.

37. A system as in claim 36, wherein the source comprises a tubular lamp located between the mask and the inner surface of the cavity.

38. A system for projecting electromagnetic radiation, comprising:

a source emitting the electromagnetic radiation;

a base comprising a cavity optically coupled to receive the electromagnetic radiation from the source, the cavity having an inner surface with a substantially diffuse reflective characteristic with respect to the electromagnetic radiation and having an opening, a perimeter of the opening of the cavity forming an aperture substantially facing a first region to be illuminated with a first portion of the electromagnetic radiation;

a port coupled to one of the defined areas and extending toward a second region to be illuminated with the electromagnetic radiation; and a deflector having at least one reflective inner surface extending from the port toward the second region to be illuminated, such that a second portion of the electromagnetic radiation emerging through the port and deflector illuminates the second region.

39. A system as in claim 38, wherein said at least one reflective inner surface of the deflector extends from a narrow end of the deflector coupled to the port to a wide end of the deflector directed toward the second region to be illuminated.

40. A system as in claim 38, wherein the deflector comprises a solid member providing total internal reflection from sides extending along the length of the solid member between an end coupled to the port and an end facing substantially toward the second region to be illuminated.

* * * * *